US006534914B2

(12) United States Patent
Amemiya et al.

(10) Patent No.: US 6,534,914 B2
(45) Date of Patent: Mar. 18, 2003

(54) PLASMA DISPLAY PANEL

(75) Inventors: Kimio Amemiya, Yamanashi-ken (JP); Yasuhiro Torisaki, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 148 days.

(21) Appl. No.: 09/773,551

(22) Filed: Feb. 2, 2001

(65) Prior Publication Data

US 2001/0026130 A1 Oct. 4, 2001

(30) Foreign Application Priority Data

Feb. 4, 2000 (JP) ..... 2000-028176

(51) Int. Cl.[7] ..... H01J 17/49

(52) U.S. Cl. ..... 313/586; 313/582; 313/584

(58) Field of Search ..... 313/485, 585, 313/586, 587, 590, 642, 582, 583, 584

(56) References Cited

U.S. PATENT DOCUMENTS 5,742,122 A * 4/1998 Amemiya et al. ..... 313/582

* cited by examiner

*Primary Examiner*—Hoang Ngo
(74) *Attorney, Agent, or Firm*—Arent Fox Kintner Plotkin & Kahn, PLLC

(57) ABSTRACT

An additional dielectric layer (11A) is formed on a backside of a dielectric layer (11) to protrude to the inside of a discharge space (S) and extend along an edge of a discharge cell C in parallel to the row direction. Row electrodes (X, Y) respectively have bus electrodes (Xb, Yb) extending along the edge of the discharge cells (C) in the row direction, and transparent electrodes (Xa, Ya) paired with each other in each discharge cell C. An overlap portion (m) of a proximal end (Xa3, Ya3) of each transparent electrode (Xa, Ya) connected to the bus electrode (Xb, Yb), which overlaps the additional dielectric layer (11A), is designed to be smaller in width than that of a linking portion (Xa2, Ya2) between the overlapping portion (m) and a distal end of the transparent electrode.

4 Claims, 8 Drawing Sheets

V 1 − V 1

V 2 − V 2

W1 – W1

W2 – W2

V 3 — V 3

W 3 — W 3

W4 — W4

PLASMA DISPLAY PANEL

BACKGROUND OF THE INVENTION

1. Field of the Invention

The invention relates to a panel structure of a plasma display panel.

2. Description of the Related Art

Recent years, a plasma display panel of a surface discharge scheme AC type as an oversize and slim display for color screen has been received attention, which is becoming widely available.

FIG. 8 is a schematically front view illustrating a conventional surface discharge scheme AC type plasma display panel. FIG. 9 is a sectional view taken along the V3—V3 line of FIG. 8. FIG. 10 is a sectional view taken along the W3—W3 line of FIG. 8. FIG. 11 is a sectional view taken along the W4—W4 line of FIG. 8.

In FIGS. 8 to 11, on the backside of a front glass substrate 1 to serve as a display screen of the plasma display panel, there is sequentially provided with a plurality of row electrode pairs (X', Y'); a dielectric layer 2 overlaying the row electrode pairs (X', Y'); and a protective layer 3 made of MgO which overlays a backside of the dielectric layer 2.

The row electrode X' consists of a T-shaped transparent electrode Xa' which is composed of a widened distal end Xa1' formed of a transparent conductive film made of ITO or the like and a narrowed linking portion Xa2', and a bus electrode Xb' formed of a metal film, extending in the row direction and connected to the linking portions Xa2' of the transparent electrode Xa'.

The row electrode Y', similarly, consists of a T-shaped transparent electrode Ya' which is composed of a widened distal end Ya1' formed of a transparent conductive film made of ITO or the like and a narrowed linking portion Ya2', and a bus electrode Yb' formed of a metal film, extending in the row direction and connected to the linking portions Ya2' of the transparent electrode Ya'.

The row electrodes X' and Y' are alternated on the front glass substrate 1 in the column direction (in the vertical direction of FIG. 8). Concerning the transparent electrodes Xa' and Ya' of the row electrode pair (X', Y') aligned along the respective bus electrodes Xb' and Yb', each of the transparent electrodes Xa' and Ya' extends toward the pair to the row electrode X' or Y'. Therefore, the tops of the respective widened distal ends Xa1' and Ya1' oppose each other to interpose a discharge gap g', having a predetermined width, between them.

Each row electrode pair (X', Y') forms a display line (row) L for matrix display.

The front glass substrate 1 faces a back glass substrate 4 with a discharge space S', filled with a discharge gas, in between.

The back glass substrate 4 is provided with a plurality of column electrodes D' arranged to extend in a direction perpendicular to the row electrode pairs X' and Y'; band-shaped partition walls 5 each extending between the adjacent column electrodes D' in parallel; and a phosphor layer 6 consisting of a red phosphor layer 6(R), green phosphor layer 6(G) and blue phosphor layer 6(B) and overlaying side faces of the partition walls 5 and the column electrodes D'.

In each display line L, the partition walls 5 divide a discharge space S' at each intersection of the column electrode D' and the row electrode pair (X', Y') to defines discharge cells C'.

As illustrated in FIG. 9 and FIG. 10, in the plasma display panel, on portion of the backside of the dielectric layer 2 which faces the bus electrodes Xb' and Yb' oriented back to back and extending in parallel, an additional dielectric layer 2A is formed to extend in parallel along the bus electrodes Xb', Yb'.

The additional dielectric layer 2A is formed to protrude from the backside of the dielectric layer 2 into the discharge space S'. The additional dielectric layer 2A has the function of limiting the spread of a surface discharge d, caused between the opposite transparent electrodes Xa' and Ya' in the discharge space S', toward the bus electrodes Xb' and Yb' so as to prevent occurrence of a false discharge between the discharge cells C' adjacent to each other in the column direction.

In the above surface discharge scheme AC type plasma display panel, an image is displayed as follows:

First, through addressing operation, discharge (opposite discharge) is caused selectively between the row electrode pairs (X', Y') and the column electrodes D' in the respective discharge cells C', to scatter lighted cells (the discharge cell in which wall charge is formed on the dielectric layer 2) and nonlighted cells (the discharge cell in which wall charge is not formed on the dielectric layer 2), over the panel in accordance with the image to be displayed.

After the addressing operation, in all the display lines L, the discharge sustain pulses are applied alternately to the row electrode pairs (X', Y') in unison, and thus, in the lighted cell, a surface discharge is caused in a space between a pair of additional dielectric layers 2A, which are adjacent to each other with the lighted cell in between, on every application of the discharge sustain pulse. The above surface discharge generates ultraviolet radiation, and thus the corresponding red(R), green (G) and/or blue (B) phosphor layers 6 in the discharge space S' are excited to emit light, resulting in forming the display image.

As explained above, in the conventional plasma display panel (PDP), the additional dielectric layer 2A formed in the portion facing the bus electrodes Xb', Yb' to extend in the row direction, limits the spreading of the discharge in the column direction in order to prevent occurrence of interference between discharges in the discharge cells C' adjacent to each other in the column direction.

In the above conventional PDP, however, since the additional dielectric layer 2A is formed in such a manner that a glass paste is screen-printed on the backside of the dielectric layer 2, and is dried and then further burned, an edge portion 2A*a* of the additional dielectric layer 2A is limp to form a gentle slop. Therefore, the edge portion 2A*a* overlaps end portions Xa2", Ya2" of the respective linking portion Xa2', Ya2' of the transparent electrodes Xa', Ya', respectively connected to the bus electrodes Xb', Yb' (an area indicated with "n" in FIG. 9).

For this reason, when an image is formed, the discharge decreases on the end portions Xa2", Ya2" of the linking portions Xa2', Ya2' of the respective transparent electrodes Xa', Ya', thereby to decrease the efficiency of light emission in this area.

Hence, there is a problem of the decreased efficiency of light emission in the entire discharge cell C.

The surface discharge caused in the discharge cell C in formation of an image may cross over the gently sloped edge portion 2A*a* of the additional dielectric layer 2A to spread out into another adjacent discharge cell C in the column direction. This may produce interference of discharge between the two adjacent discharge cells C in the column direction. In the event of the interfering discharges, lighted and unlighted discharge cells may be reversed to produce an instable and inaccurate image.

SUMMARY OF THE INVENTION

The present invention has been made to solve the disadvantages associated with the conventional plasma display panel as described above.

It is therefore an object of the present invention to provide a plasma display panel which is capable of improving the efficiency of light emission in each discharge cell, and also effectively preventing interference of discharge from occurring between the adjacent discharge cells to display stable images.

To attain the above objects, a plasma display panel according to a first invention includes a plurality of row electrode pairs extending in a row direction and arranged in a column direction to form display lines and a dielectric layer overlaying the row electrode pairs on a backside of a front substrate, and a plurality of column electrodes extending in the column direction and arranged in the row direction on a back substrate facing the front substrate via a discharge space, unit light emitting areas being formed in the discharge space at respective intersections of the column electrodes and the row electrode pairs. Such plasma display panel features in that: an additional portion is formed on a backside of the dielectric layer to protrude to the inside of the discharge space and extend along an edge of the unit light emitting area extending in parallel to the row direction; in that each row electrode of the row electrode pair has a bus electrode extending along the edge of the unit light emitting area in the row direction, and transparent electrodes connected to the bus electrode and each extending toward the mate of the row electrode of the row electrode pair for each unit light emitting area, the transparent electrode of each one row electrode opposing to the transparent electrode of the other row electrode via a gap having a predetermined width; and in that when viewed from the front substrate, an overlap portion of a proximal end of the transparent electrode of each of the row electrode connected to the bus electrode, which overlaps the additional dielectric layer, is designed to be smaller in width than that of a portion between the overlap portion and a distal end of the transparent electrode.

In the plasma display panel according to the first invention, an image is formed by selectively performing a discharge between the transparent electrodes opposing to and paired with each other in each unit light emitting area. The portion of the proximal end of the transparent electrode of each row electrode which is connected to the bus electrode overlaps the additional dielectric layer for prevent a false discharge. The above overlapping portion has a width smaller than that of the portion between the overlapping portion and the distal end. For this reason, in the discharge, the discharge is decreased in the overlapping portion between the transparent electrode and the additional dielectric layer, and performed mainly in the distal ends of the respective transparent electrodes which are paired with and face each other.

In consequence, according to the first invention, the additional dielectric layer less obstructs a discharge caused in forming an image. This improves the efficiency of light emission. Further, since the discharge for forming an image is performed mainly in a central portion of each unit light emitting area, the discharge is limited going beyond the additional dielectric layer to spread out into an adjacent unit light emitting area in the column direction to prevent occurrence of the false discharge.

To attain the aforementioned object, the plasma display panel according to a second invention features, in addition to the configuration of the first invention, in that the transparent electrode is formed in an approximately T-shape by a widened portion opposing to the pair of the transparent electrode, and a narrowed portion linking the widened portion to the bus electrode and having a smaller width than that of the widened portion, wherein a portion of the narrowed portion overlapping the additional dielectric layer is designed to be further smaller in width than that of a distal portion of the narrowed portion on the widened portion side.

According to the plasma display panel of the second invention, the overlap portion of the narrowed portion of the approximately T-shaped transparent electrode linking the widened portion with the bus electrode, which overlaps the additional dielectric layer, is formed to be further smaller in width than that of another portion of the narrowed portion on the widened portion side. As a result, since a discharge is decreased on the overlap portion of the transparent electrode with the additional dielectric layer, the efficiency of light emission is improved and occurrence of a false discharge is prevented by limiting the spread of the discharge going beyond the additional dielectric layer into another adjacent unit light emitting area in the column direction.

To attain the aforementioned objects, the plasma display panel according to a third invention features, in addition to the configuration of the first invention, in that a width of the transparent electrode is decreased gradually from the distal end thereof toward the proximal end thereof connected the bus electrode.

According to the plasma display panel of the third invention, in the connection side of the transparent electrode with the bus electrode, the overlap portion with the additional dielectric layer is smaller in width than that of the distant end of the transparent electrode. As a result, since a discharge is decreased on the overlap portion of the transparent electrode with the additional dielectric layer, the efficiency of light emission is improved and occurrence of a false discharge is prevented by limiting the spread of the discharge going beyond the additional dielectric layer into another adjacent unit light emitting area in the column direction.

To attain the aforementioned objects, the plasma display panel according to a fourth invention features, in addition to the configuration of the first invention, in that an a really enlarged portion is formed in a portion of the proximal end of the transparent electrode overlaying the bus electrode for connection.

According to the plasma display panel of the fourth invention, due to the smaller width of the overlap portion of the proximal end of the transparent electrode with the additional dielectric layer, the efficiency of light emission is improved and occurrence of a false discharge is prevented.

In the plasma display panel, due to a small width of the proximal end of the transparent electrode connected to the bus electrode, the transparent electrode and the bus electrode easily separate from each other. For this reason, the a really enlarged portion is formed on the portion of the proximal end of the transparent electrode overlaying the bus electrode, thereby to prevent the transparent electrode and the bus electrode from separating from each other.

These and other objects and advantages of the present invention will become obvious to those skilled in the art upon review of the following description, the accompanying drawings and appended claims.

DETAILED DESCRIPTION OF THE PREFERRED EMBODIMENT

Most preferred embodiment according to the present invention will be described hereinafter in detail with reference to the accompanying drawings.

Figure 1:
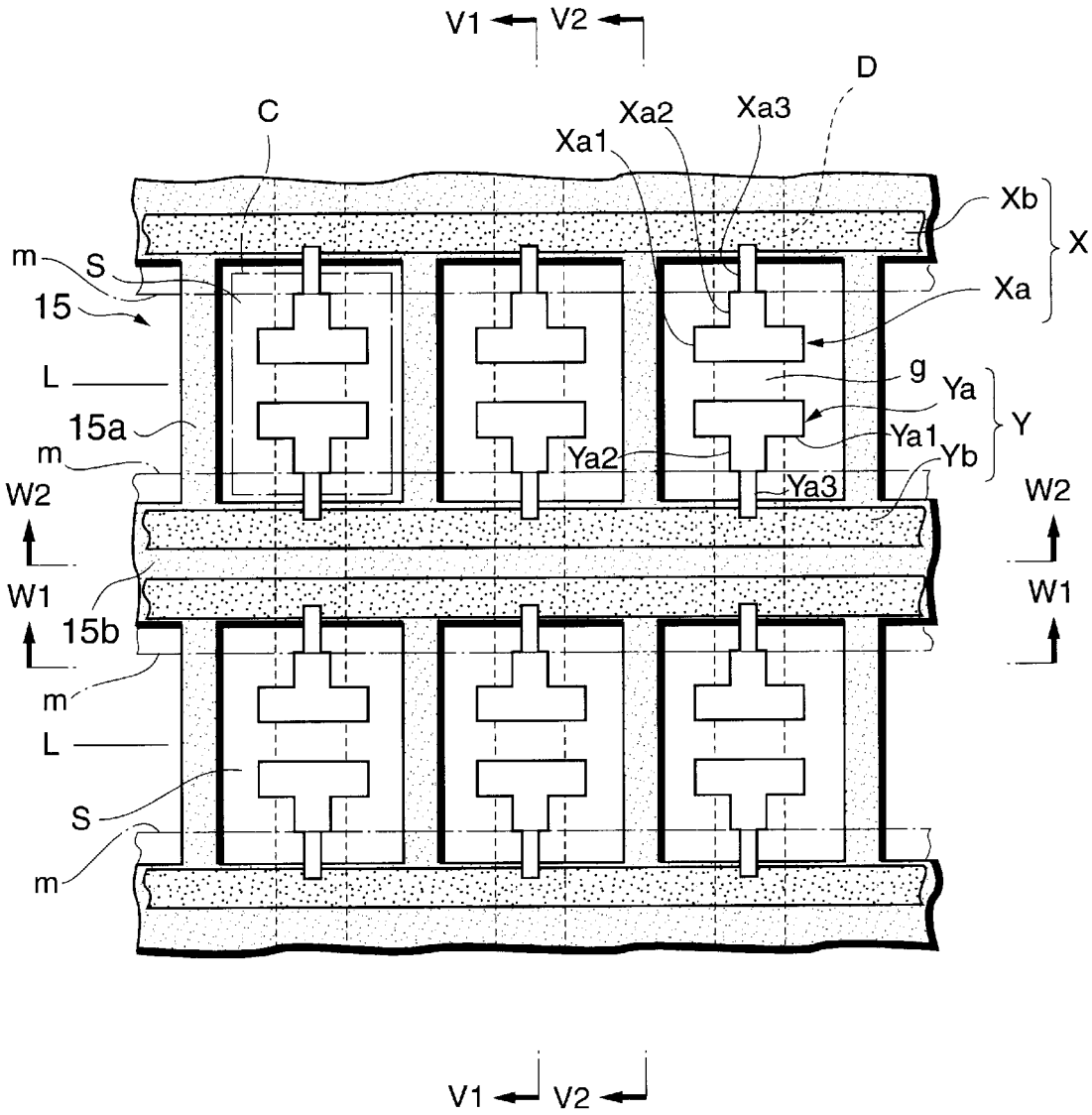
FIG. 1 is a front view schematically showing a first example in an embodiment according to the present invention.
Figure 2:
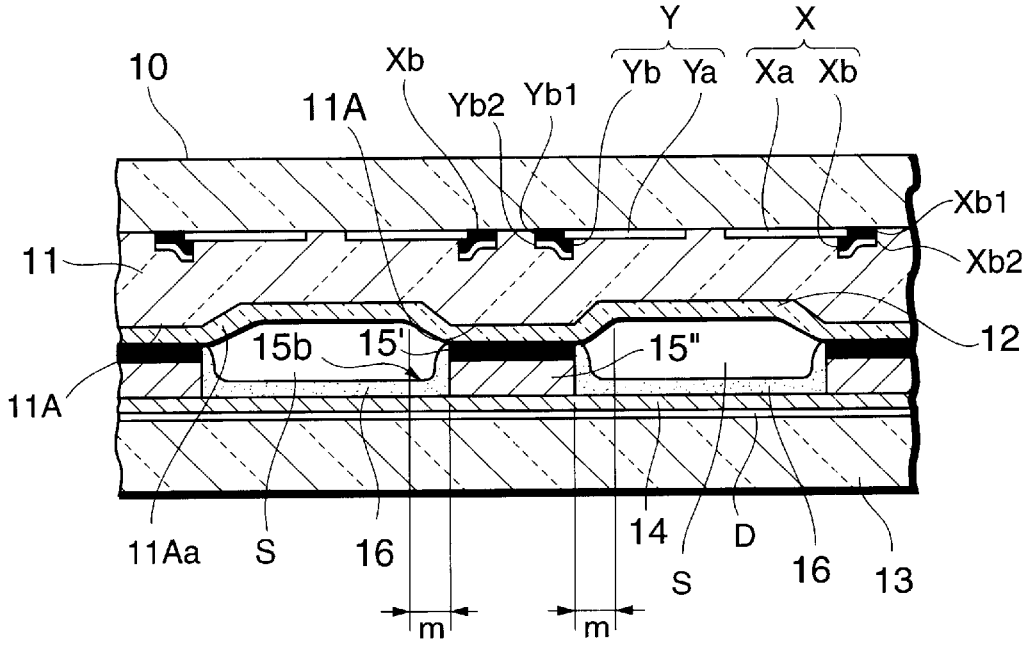
FIG. 2 is a sectional view taken along the V1—V1 line of FIG. 1.
Figure 3:
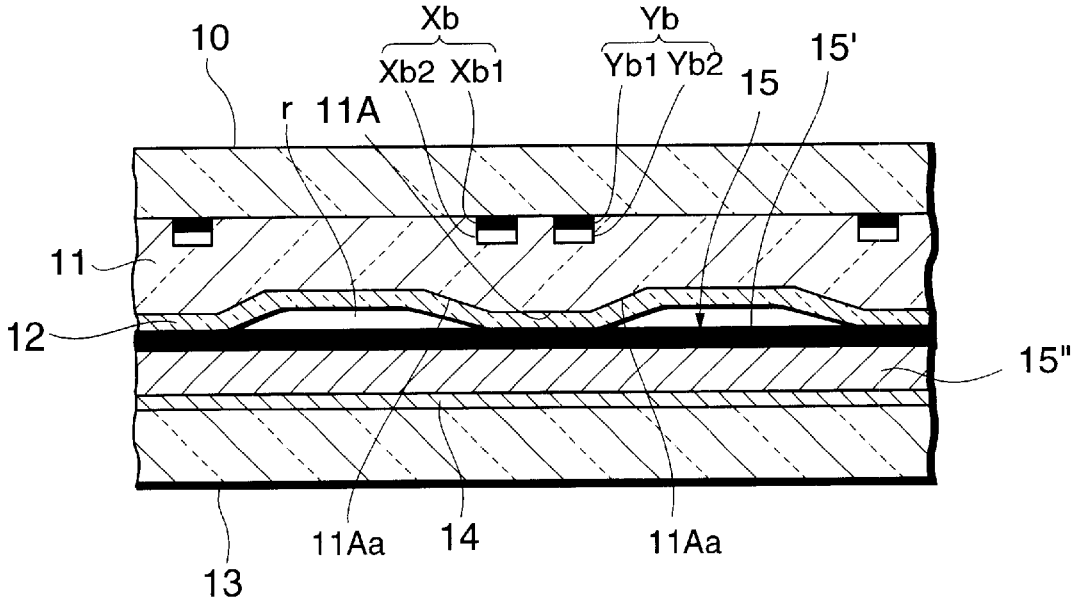
FIG. 3 is a sectional view taken along the V2—V2 line of FIG. 1.
Figure 4:
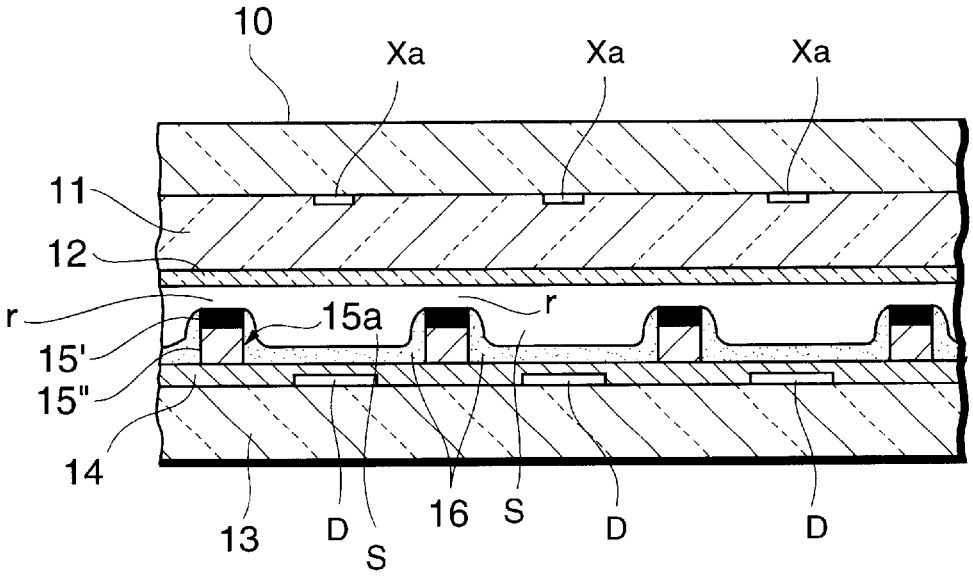
FIG. 4 is a sectional view taken along the W1—W1 line of FIG. 1.
Figure 5:
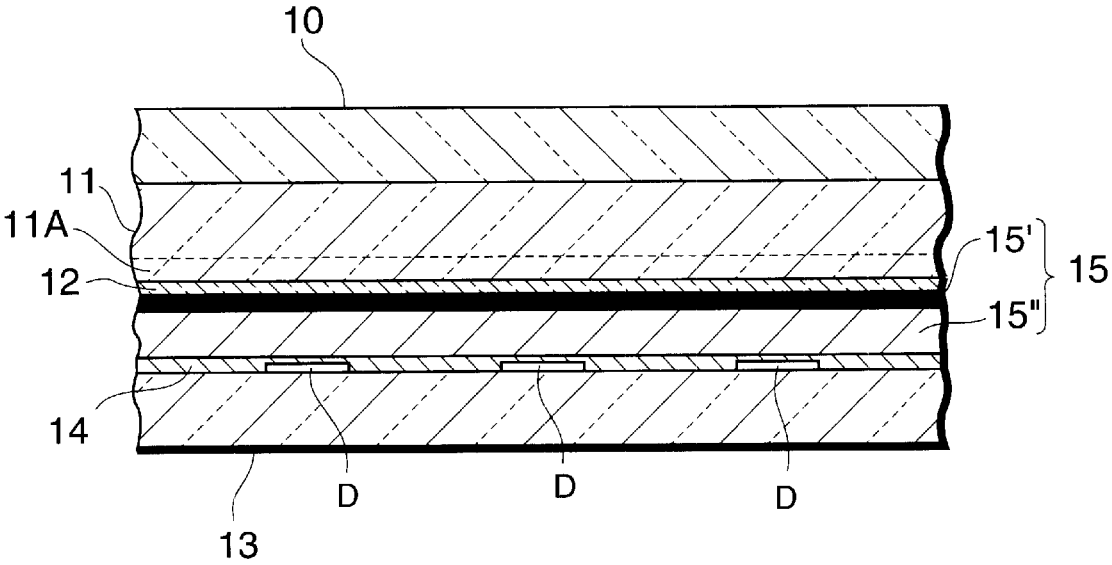
FIG. 5 is a sectional view taken along the W2—W2 line of FIG. 1.

FIGS. 1 to 5 illustrate an example of the embodiment of a plasma display panel (referred as "PDP" hereinafter) according to the present invention. FIG. 1 is a front view schematically presenting a relation between a row electrode pair and a partition wall. FIG. 2 is a sectional view taken along the V1—V1 line of FIG. 1. FIG. 3 is a sectional view taken along the V2—V2 line of FIG. 1. FIG. 4 is a sectional view taken along the W1—W1 line of FIG. 1. FIG. 5 is a sectional view taken along the W2—W2 line of FIG. 1.

In FIG. 1 to FIG. 5, on a backside of a front glass substrate 10 serving as a display surface, a plurality of row electrode pairs (X, Y) are arranged in parallel to extend in the row direction (the traverse direction in FIG. 1) of the front glass substrate 10.

A row electrode X consists of transparent electrodes Xa formed of a transparent conductive film made of ITO or the like, and a bus electrode Xb extending in the row direction and connected to the transparent electrode Xa.

The transparent electrode Xa is composed of a widened distal end Xa1, a narrowed linking portion Xa2 extending from a central portion of the distal end Xa1 in a direction perpendicular to the distal end Xa1, and a proximal end Xa3 formed to be coaxial with the linking portion Xa2 and to have a width smaller than that of the linking portion Xa2, which form the transparent electrode Xa in a T-like shape as a whole. The proximal end Xa3 is connected to the bus electrode Xb.

A length of the proximal end Xa3 of the transparent electrode Xa in the axis direction is set to be approximately equal to a length of overlap between an additional dielectric layer and the transparent electrode Xa as described later.

Likewise, a row electrode Y consists of transparent electrodes Ya formed of a transparent conductive film made of ITO or the like, and a bus electrode Yb extending in the row direction and connected to the transparent electrode Ya.

The transparent electrode Ya is composed of a widened distal end Ya1, a narrowed linking portion Ya2 extending from a central portion of the distal end Ya1 in a direction perpendicular to the distal end Ya1, and a proximal end Ya3 formed to be coaxial with the linking portion Ya2 and to have a width smaller than that of the linking portion Ya2, which form the transparent electrode Ya in a T-like shape as a whole. The proximal end Ya3 is connected to the bus electrode Yb.

A length of the proximal end Ya3 of the transparent electrode Ya in the axis direction is set to be approximately equal to a length of overlap between of an additional dielectric layer and the transparent electrode Ya as described later.

The row electrodes X and Y are alternated on the front glass substrate 10 in the column direction (in the vertical direction of FIG. 1). Concerning the transparent electrodes Xa and Ya of the row electrode pair (X, Y) aligned along the respective bus electrodes Xb and Yb, each of the transparent electrodes Xa and Ya extends toward the pair to the row electrode X or Y. Therefore, the tops of the respective widened distal ends Xa1 and Ya1 oppose each other to interpose a discharge gap g, having a predetermined width, between them.

Each row electrode pair (X, Y) forms a display line (row) L for matrix display.

Each of the bus electrodes Xb and Yb is formed in a double-layer structure with a black conductive layer Xb1 or Yb1 on the display surface side and a main conductive layer Xb2 or Yb2 on the back surface side.

On the backside of the front substrate 10, a dielectric layer 11 is further formed to overlay the row electrode pairs (X, Y). Furthermore, on the backside of the dielectric layer 11, an additional dielectric layer 11A is formed in each position which opposes the adjacent bus electrodes Xb and Yb of the respective row electrode pairs (X, Y) adjacent to each other, plus which opposes an area between the adjacent bus electrodes Xb and Yb, to protrude from the backside of the dielectric layer 11 and to extend in parallel to the bus electrodes Xb, Yb.

The additional dielectric layer 11A is formed in such a manner that a glass paste is screen-printed on the backside of the dielectric layer 11, and is dried and then further burned.

On the backsides of the dielectric layer 11 and the additional dielectric layers 11A, a protective layer 12 made of MgO is formed.

Next, a back glass substrate 13 is arranged in parallel to the front glass substrate 10. On the front face of the back glass substrate 13 orienting toward the display surface, column electrodes D are disposed in parallel at regularly established intervals from one another to extend at positions opposing to the transparent electrodes Xa and Ya of the respective pairs of the row electrodes (X, Y) in a direction orthogonal to the row electrode pair (X, Y) (the column direction).

On the face of the back glass substrate 13 on the display surface side, a white dielectric layer 14 is further formed to overlay the column electrodes D, and the partition wall 15 is formed on the dielectric layer 14.

The partition wall 15 is formed in a pattern, in which parallel lines cross at right angles, by a vertical wall 15*a* extending in the column direction between the adjacent column electrodes D arranged in parallel to each other, and a transverse wall 15*b* extending in the row direction at a position opposing to the additional dielectric layer 11A.

The partition wall 15 defines the discharge space S between the front glass substrate 10 and the back glass substrate 13 into areas of a chessboard-square-like pattern to form a quadrangular discharge cell C for each defined area opposing to the paired transparent electrodes Xa and Ya in each row electrode pair (X, Y).

The partition wall 15 is formed in a double layer structure with a black layer (a light absorption layer) 15' on the display surface side and a white layer (a light reflection layer) 15" on the back surface side, which is configured such that the side wall facing the discharge cell C is almost white (i.e. a light reflection layer).

The face of the transverse wall 15*b* of the partition wall 15 on the display surface side is in contact via the protective layer 12 with the additional dielectric layer 11A. The additional dielectric layer 11A and the transverse wall 15*b* shield the adjacent discharge cells C in the column direction from each other.

A clearance r is formed between the vertical wall 15*a* of the partition wall 15 and the protective layer 12 overlaying the dielectric layer 11.

On the five faces of a surface of the dielectric layer 14 and the side faces of the vertical walls 15*a* and the transverse walls 15*b* of the partition wall 15 facing each discharge cell C, a phosphor layer 16 is formed to overlay all of them.

The phosphor layers 16 are set in order of red (R), green (G) and blue (B) in the particular discharge cells in the row direction.

The discharge space of each of the discharge cells C is filled with a discharge gas.

In the above PDP, each row electrode pair (X, Y) makes up a display line (row) L on a matrix display screen. The partition wall 15 in a parallel-crosses-like pattern defines the discharge space S into the chessboard-square-like pattern to form the quadrangular discharge cells C.

Next, operation of displaying an image on the PDP is carried out as in the case of the conventional PDP.

Specifically, first, through addressing operation, the discharge is performed selectively between the row electrode pair (X, Y) and the column electrode D in each discharge cell C, to scatter lighted cells (the discharge cells in which the wall charge is formed on the dielectric layer 11) and non-lighted cells (the discharge cells in which the wall charge is formed on the dielectric layer 11), in all the display lines L over the panel in accordance with the image to be displayed.

After the addressing operation, in all the display lines L, the discharge sustain pulse is applied alternately to the row electrode pairs (X, Y) in unison. In each lighted cell, surface discharge is caused for every application of the sustaining discharge pulse.

In this manner, the surface discharge in each lighted cell generates ultraviolet radiation, and thus the red, green and/or blue phosphor layers 16 formed in the discharge space S are excited to emit light, resulting in forming a display screen.

In the above PDP, the additional dielectric layer 11A formed on the dielectric layer 11 is in contact with the face of the transverse wall 15*b* of the partition wall 15 on the display surface side via the protective layer 12 overlaying the additional dielectric layer 11A to shield the adjacent discharge cells C in the column direction from each other. This prevents interference of discharges from occurring between the adjacent discharge cells C in the column direction.

Filling each discharge cell C with the discharge gas or removing the discharge gas from the discharge cell C are performed the clearance r formed between the vertical wall 15*a* and the protective layer 12 overlaying the dielectric layer 11. Further, the priming effect of causing the discharge between the adjacent discharge cells C in the row direction such as in a chain reaction, or causing the discharge to transfer to the adjacent discharge cell C, is secured through the clearance r.

In the above PDP, as in the case of the conventional PDP, since the additional dielectric layer 11A is also formed in such a manner that a glass paste is screen-printed on the backside of the dielectric layer 2, an edge portion 11A*a* of the additional dielectric layer 2A is limp to form a gentle slop. Therefore, a portion m of the edge portion 11A*a* protruding into the discharge cell C overlaps each proximal end Xa3, Ya3 of the transparent electrodes Xa, Ya.

In this point, as has been discussed, each length of the proximal end Xa3, Ya3 set to be approximately equal to a length of overlap between the edge portion 11A*a* of the additional dielectric layer 11A and the transparent electrode Xa, Ya, and further each width of the proximal ends Xa3, Ya3 of the transparent electrodes Xa, Ya is set to be further smaller than a respective width of the linking portions Xa2, Ya2. This decreases the discharge of the surface discharge, caused when an image is formed, around the proximal ends Xa3, Ya3, and allows the surface discharge to perform mainly between the distal end Xa1 and linking portion Xa2 of the transparent electrode Xa and the distal end Ya1 and linking portion Ya2 of the transparent electrode Ya.

In consequence, the efficiency of light emission by the surface discharge in forming an image is improved, and also the surface discharge is performed mainly in the central portion of the discharge cell C. Therefore, it is possible to limit the spread of the discharge going beyond the edge portion 11A*a* of the additional dielectric layer 11A into another adjacent discharge cell C so as to prevent occurrence of a false discharge.

Figure 6:
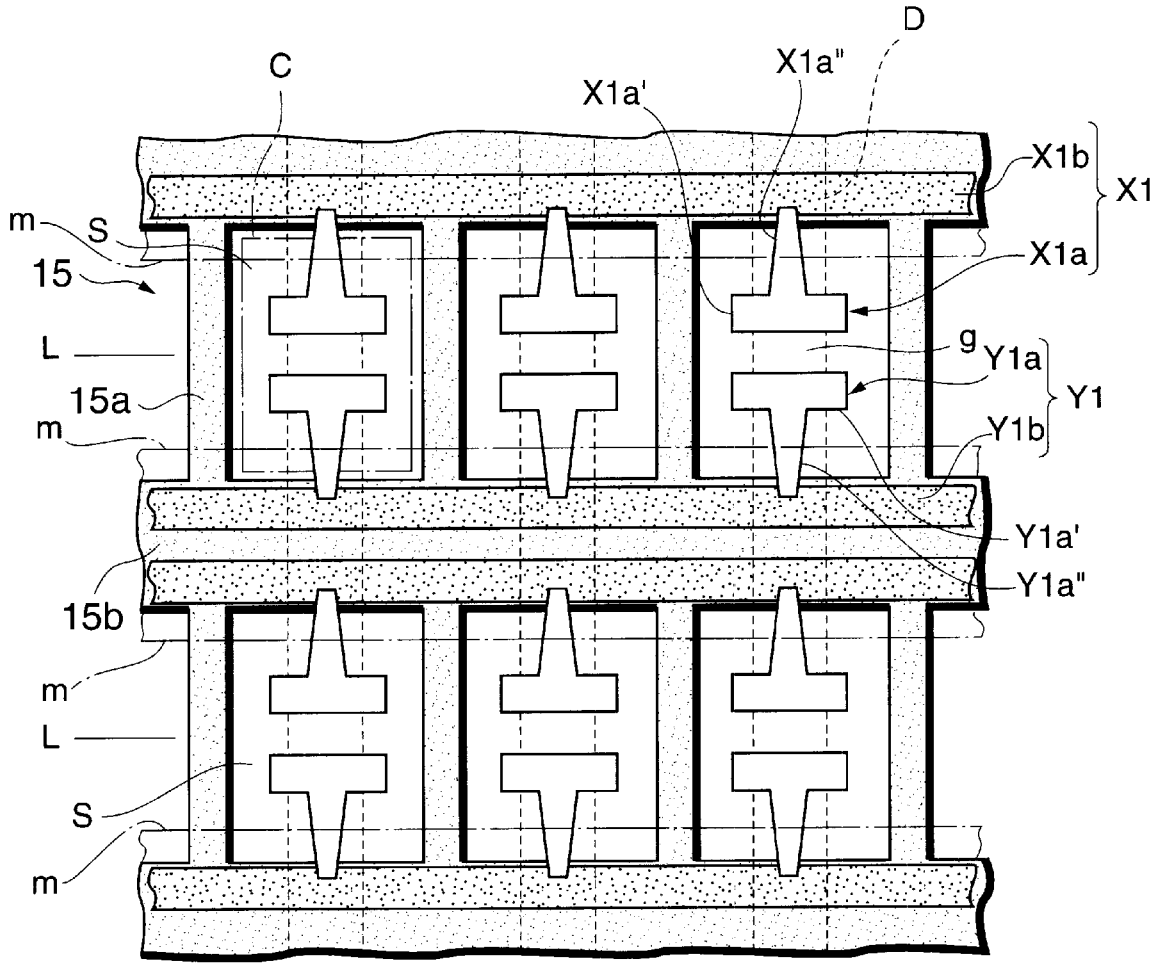
FIG. 6 is a front view schematically showing a second example in the embodiment according to the present invention.

FIG. 6 is a front view illustrating a second example in the embodiment of the plasma display panel according to the present invention.

A row electrode X1 of a PDP in the second example consists of transparent electrodes X1*a* formed of a transparent conductive film made of ITO or the like, and a bus electrode X1*b* extending in the row direction and connected to the transparent electrode X1*a*.

The transparent electrode X1*a* is formed in an approximately T-like shape by a widened distal end X1*a*', and a linking portion X1*a*" extending from a central portion of the distal end X1*a*' in a direction perpendicular to the distal end Xa1' The proximal end is connected to the bus electrode X1*b*.

The linking portion X1*a*" of the transparent electrode X1*a* is formed to decrease in width gradually from the distal end X1*a*' toward a proximal end thereof connected to the bus electrode X1*b*.

Likewise, a row electrode Y1 consists of transparent electrodes Y1*a* formed of a transparent conductive film made of ITO or the like, and a bus electrode Y1*b* extending in the row direction and connected to the transparent electrode Y1*a*.

The transparent electrode Y1*a* is formed in an approximately T-like shape by a widened distal end Y1*a*', and a linking portion Y1*a*" extending from a central portion of the distal end Y1*a*' in a direction perpendicular to the distal end Ya1'. The proximal end is connected to the bus electrode Y1*b*.

The linking portion Y1*a*" of the transparent electrode Y1*a* is formed to decrease in width gradually from the distal end Y1*a*' toward a proximal end thereof connected to the bus electrode Y1*b*.

Other parts of the configuration are the same as or similar to those of the foregoing PDP in the first example, so that the same reference numerals are used.

As in the first example, with the PDP in the second example, an edge portion of an additional dielectric layer is limp to form a gentle slop (see FIG. 2). Therefore, a portion m of the edge portion protruding into the discharge cell C overlaps each linking portion X1*a*", Y1*a*" of the transparent electrodes X1*a*, Y1*a*.

However, since the width of each proximal end of the linking portions X1*a*", Y1*a*" is formed to decrease in width gradually from the distal end X1*a*', Y1*a*' toward a proximal end thereof connected to the bus electrode X1*b*, Y1*b*, the discharging when an image is formed is reduced on each proximal end of the linking portions X1*a*", Y1*a*" overlapping the additional dielectric layer. This allows the surface discharge to perform mainly between the distal end X1*a*' and distal portion of the linking portion X1*a*" of the transparent electrode X1*a* and the distal end Y1*a*' and distal portion of the linking portion Y1*a*" of the transparent electrode Y1*a*.

In consequence, the efficiency of light emission by the surface discharge in forming an image is improved, and also the surface discharge is performed mainly in the central portion of the discharge cell C. Therefore, it is possible to limit the spread of the discharge from going beyond the edge portion of the additional dielectric layer toward another adjacent discharge cell C to prevent occurrence of a false discharge.

Figure 7:
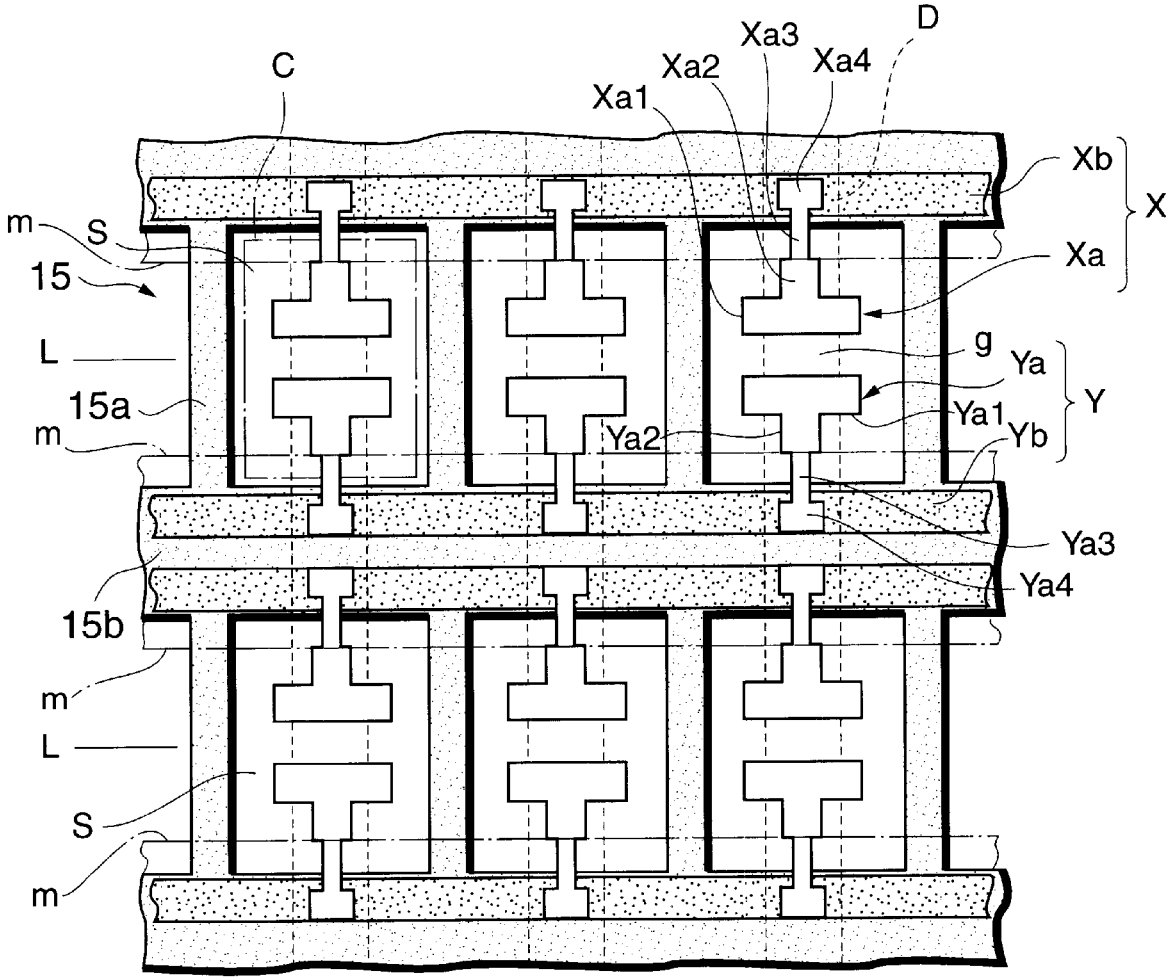
FIG. 7 is a front view schematically showing a third example in the embodiment according to the present invention.

FIG. 7 is a front view illustrating a third example in the embodiment of the plasma display panel according to the present invention.

As in the first example, a transparent electrode Xa of a row electrode X of a PDP in the third example is composed of a widened distal end Xa1, a narrowed linking portion Xa2 extending from a central portion of the distal end Xa1 in a direction perpendicular to the distal end Xa1, and a proximal end Xa3 formed to be coaxial with the linking portion Xa2 and to have a width smaller than that of the linking portion Xa2, which form the transparent electrode Xa in an approximately T-like shape as a whole. The proximal end Xa3 is connected to a bus electrode Xb.

A length of the proximal end Xa3 in the axis direction is set to be approximately equal to a length of overlap between an additional dielectric layer and the transparent electrode Xa (see FIG. 2).

Besides the above configuration, the transparent electrode Xa is further provided integrally with a widthwise enlarged portion Xa4, having a larger width than that of the proximal end Xa3, at a portion of the proximal end Xa3 connected to the bus electrode Xb.

Likewise, a transparent electrode Ya of a row electrode Y is composed of a widened distal end Ya1, a narrowed linking portion Ya2 extending from a central portion of the distal end Ya1 in a direction perpendicular to the distal end Ya1, and a proximal end Ya3 formed to be coaxial with the linking portion Ya2 and to have a width smaller than that of the linking portion Ya2, which form the transparent electrode Ya in an approximate T-like shape as a whole. The proximal end Ya3 is connected to a bus electrode Yb, and a length thereof in the axis direction is set to be approximately equal to a length of overlap between an additional dielectric layer (see FIG. 2) and the transparent electrode Ya.

Besides the above configuration, the transparent electrode Ya is further provided integrally with a widthwise enlarged portion Ya4, having larger in width than that of the proximal end Ya3, at a portion of the proximal end Ya3 connected to the bus electrode Yb.

Other parts of the configuration are the same as or similar to those of the foregoing PDP in the first example, so that the same reference numerals are used.

As in the PDP of the first example, with the PDP in the third example, the efficiency of light emission by the surface discharge in forming an image is improved, and also it is possible to limit the spread of the discharge toward another adjacent discharge cell C to prevent occurrence of a false discharge.

With the PDP in the third example, the widthwise enlarged portions Xa4, Ya4 respectively formed in the portions of the transparent electrodes Xa, Ya connected to the bus electrodes Xb, Yb prevent the transparent electrode Xa, Ya and the bus electrodes Xb, Yb from coming off.

Figure 8:
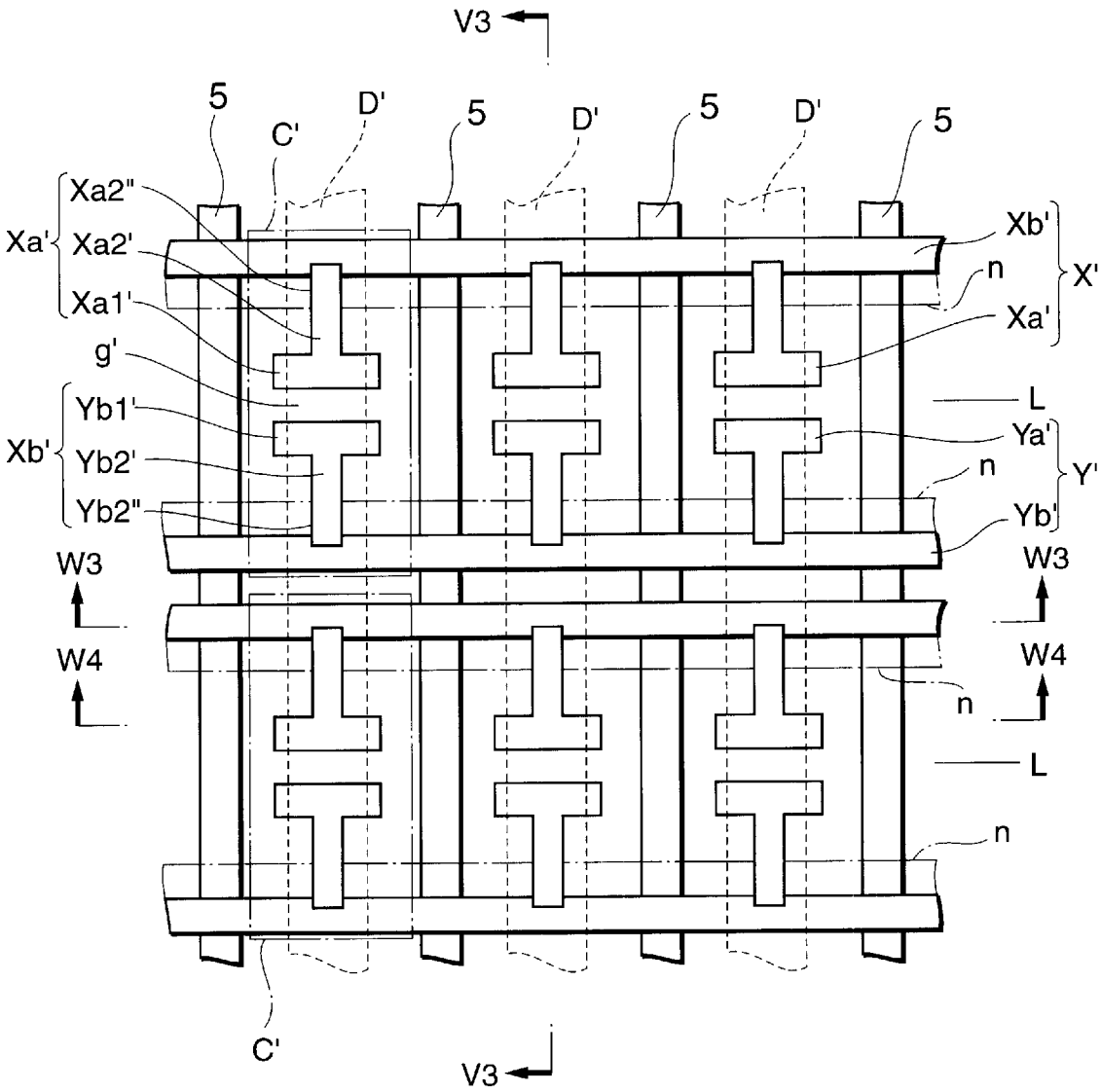
FIG.8 PRIOR ART
FIG. 8 is a front view schematically showing of a conventional plasma display panel.
Figure 9:
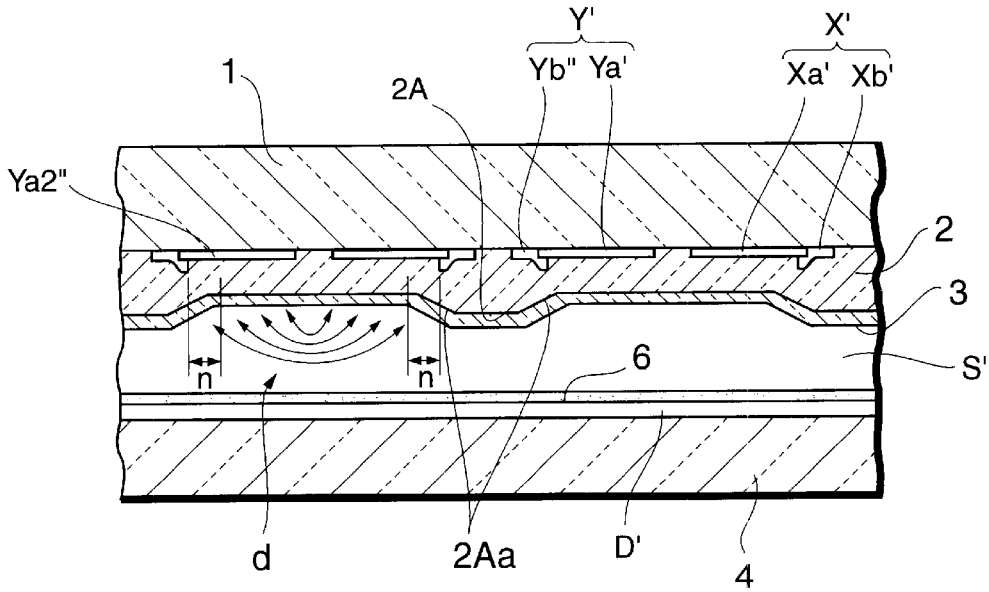
FIG.9 PRIOR ART
FIG. 9 is a sectional view taken along the V3—V3 line of FIG. 8.
Figure 10:
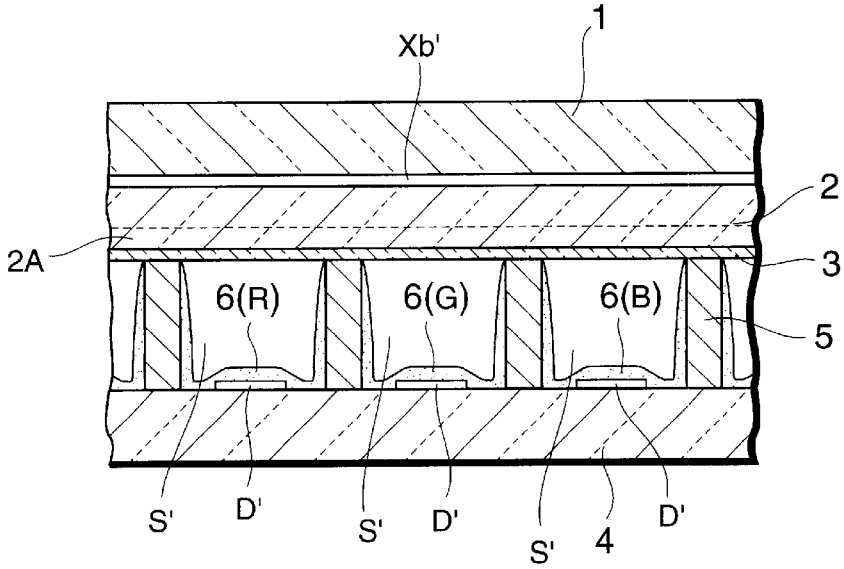
FIG.10 PRIOR ART
FIG. 10 is a sectional view taken along the W3—W3 line of FIG. 8.
Figure 11:
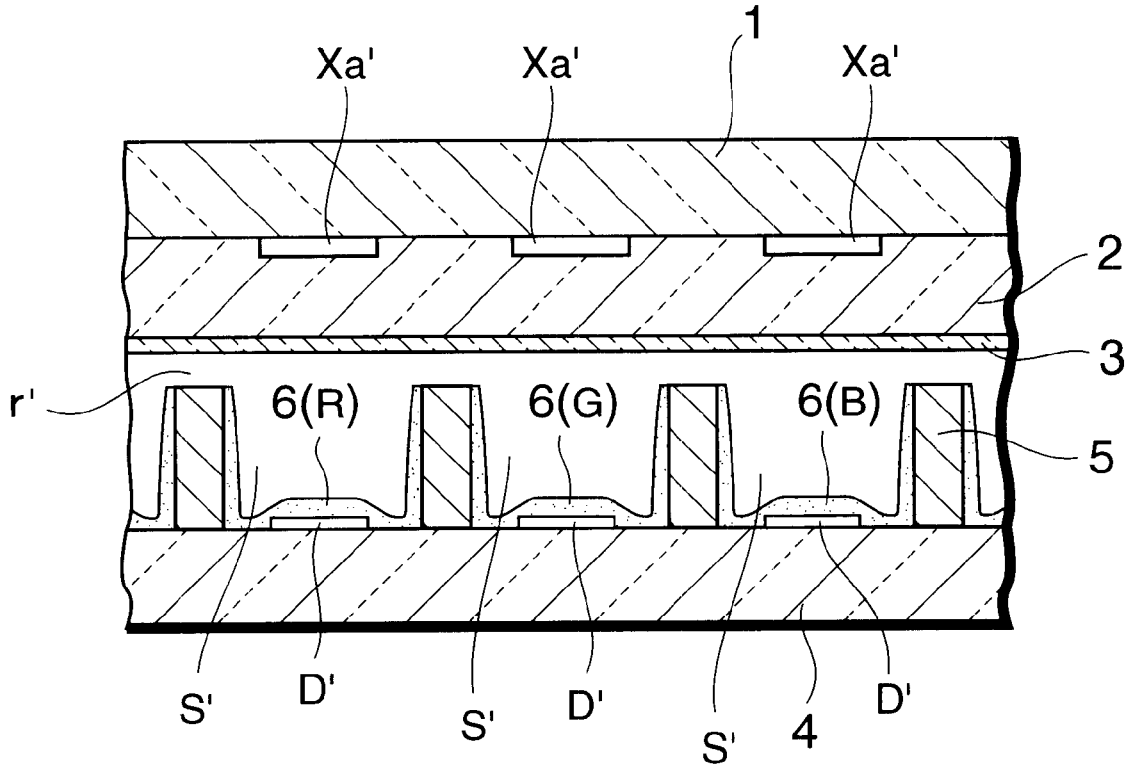
FIG.11 PRIOR ART
FIG. 11 is a sectional view taken along the W4—W4 line of FIG. 8.

In each forgoing example, the description has been made for the PDP in which the partition wall defining the discharge cell includes the vertical walls and the transverse wall and the discharge space is defined into a pattern in which parallel lines cross at right angles. However, each invention of the present invention can be also applied to the PDP in which the partition wall is formed in a band-like shape extending in the column direction as illustrated in FIG. 8.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a plurality of row electrode pairs extending in a row direction and arranged in a column direction to form display lines and a dielectric layer overlaying the row electrode pairs on a backside of a front substrate, and a plurality of column electrodes extending in the column direction and arranged in the row direction on a back substrate facing the front substrate via a discharge space, unit light emitting areas being formed in the discharge space at respective intersections of the column electrodes and the row electrode pairs, said plasma display panel comprising:

an additional portion formed on a backside of the dielectric layer to protrude to the inside of the discharge space and extend along an edge of the unit light emitting area extending in parallel to the row direction, wherein each row electrode of said row electrode pair has a bus electrode extending along the edge of the unit light emitting area in the row direction, and transparent electrodes connected to the bus electrode and each extending toward the mate of said row electrode of said row electrode pair for each unit light emitting area, said transparent electrode of each one row electrode opposing to said transparent electrode of the other row electrode via a gap having a predetermined width, wherein when viewed from the front substrate, an overlap portion of a proximal end of said transparent electrode of each of said row electrode connected to the bus electrode, overlapping said additional dielectric layer, is designed to be smaller in width than that of a portion between said overlap portion and a distal end of the transparent electrode.

2. The plasma display panel according to claim 1, wherein said transparent electrode is formed in an approximately T-shape by a widened portion opposing to the pair of the transparent electrode, and a narrowed portion linking said widened portion to the bus electrode and having a smaller width than that of said widened portion, wherein a portion of said narrowed portion overlapping said additional dielectric layer is designed to be further smaller in width than that of a distal portion of the narrowed portion on the widened portion side.

3. The plasma display panel according to claim 1, wherein a width of said transparent electrode is decreased gradually from the distal end thereof toward the proximal end thereof connected to the bus electrode.

4. The plasma display panel according to claim 1, wherein an a really enlarged portion is formed in a portion of the proximal end of said transparent electrode overlaying the bus electrode for connection.

* * * * *